United States Patent [19]

Goench

[11] Patent Number: 5,010,644

[45] Date of Patent: Apr. 30, 1991

[54] NAIL CLIPPING ENCOMPASSING CONTAINER TO RETAIN NAIL CLIPPINGS

[76] Inventor: Mahmut I. Goench, 77-68 270 St., New Hyde Park, N.Y. 11040

[21] Appl. No.: 409,021

[22] Filed: Oct. 26, 1989

[51] Int. Cl.[5] ..... A45D 29/00

[52] U.S. Cl. ..... 30/28; 132/75.5

[58] Field of Search ..... 30/28; 132/75.5

[56] References Cited

U.S. PATENT DOCUMENTS 2,664,624 1/1954 Bassett ..... 132/75.5

4,614,031 9/1986 Chen ..... 30/28

*Primary Examiner*—Douglas D. Watts

*Attorney, Agent, or Firm*—Collard, Roe & Galgano

[57] ABSTRACT

The invention contemplates nail clippers comprising a single-piece clippings container being an integral part of a conventional nail clipper of the kind in which elongated jaw members are connected at one end and diverge toward the other end. The clippings retainer being an integral part of the lower jaw of the clippers while the upper jaw is designed such that it completely covers the lower jaw with the retainer box, preventing any clippings from being scattered during the clipping process.

4 Claims, 2 Drawing Sheets

NAIL CLIPPING ENCOMPASSING CONTAINER TO RETAIN NAIL CLIPPINGS

BACKGROUND OF THE INVENTION

The invention relates to nail clippers, such as fingernail clippers and toenail clippers, of the variety in which like elongate jaw members are secured to each other at one end and diverge in the direction of their opposite ends, where opposed cutting edges are actuable.

In using such clippers it has always been a problem that both hands are occupied, while one hand is holding and actuating the clippers while the other hand is being clipped or holding the toe to be clipped. For this reason clippings will scatter in all directions.

Various forms of devices have been proposed to avoid loss of clippings, but for one reason or another they have not been accepted by the public.

For example, in one variety a plastic tray is permanently attached to the nail clipper, while in another, a plastic sock is removably assembled over the nail clipper.

BRIEF STATEMENT OF THE INVENTION

It is an object of the invention to provide an improved new nail clipper which is capable of retaining the nail clippings at the moment of clipping a nail.

In order to achieve the above object of the invention, a new lower jaw design is introduced, where an open box, being an integral part of this jaw, is provided to catch and confine the nail clippings.

The box of the lower jaw is so tailored that in the nail clipping mode the upper jaw covers the box of the lower jaw completely, thus preventing any nail clippings from flying out of the box. The nail clippings can be readily disposed of in the non-clipping mode.

DETAILED DESCRIPTION

The invention is described in detail in the accompanying drawings as follows.

Figure 2:
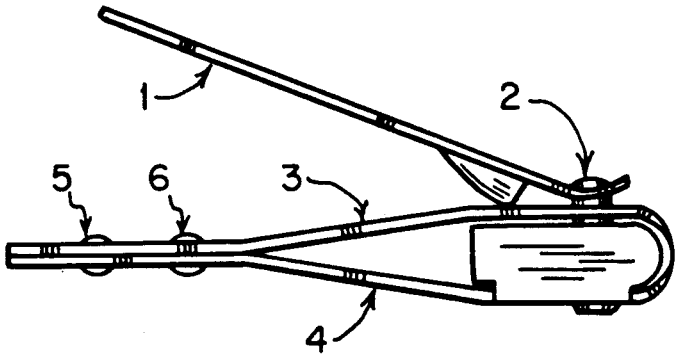
FIG. 2 is a side view of the nail clipper of this invention in its clipping mode. The numbers refer to the same items described in FIG. 1.
Figure 3:
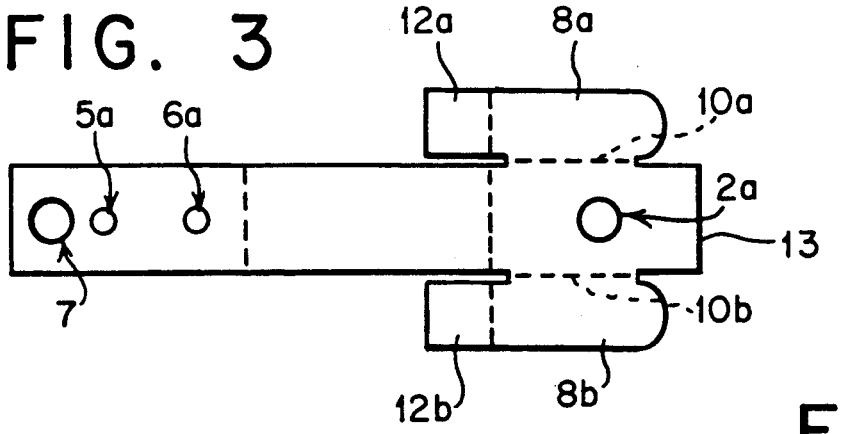
Figure 4:
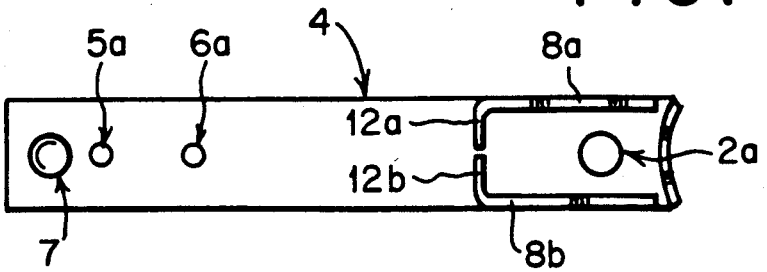

FIG. 3 is the cut sheet metal shape of the lower jaw of the nail clipper according to this invention, wherein 2*a*, 5*a* and 6*a* refer to openings for the rivets shown in FIG. 1 and FIG. 2, while 7 refers to a so-called "convenience opening" providing a hole for hanging up the clipper; 8a and 8*b* represent extensions of the blank sheet metal which subsequently are bent to form the three sides of the nail clipping retaining box as shown in FIG. 4.

FIG. 4 is the formed shape of the lower jaw of the nail clipper of this invention where 8*a* and 8*b* indicate three sides of the box while 9 shows the fourth side of the box, representing the bent and sharpened front edge of the clipper, the shape of which may be similar to that employed in commercially available nail clippers.

Figure 5:
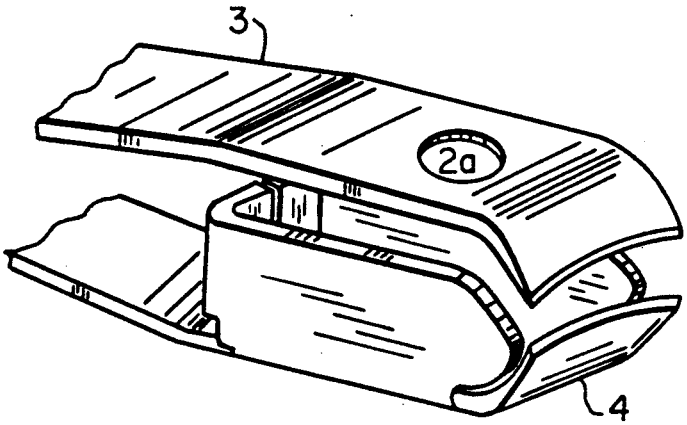

FIG. 5 shows the nail clippings retaining box in the non-clipping mode, where lower jaw 4 leading into the cutting edge, has a minimum bending radius of 1/16", making an angle from the bottom plane of the box of approximately 45 degrees. The upper jaw having symmetrical bending radius and angle.

Figure 6:
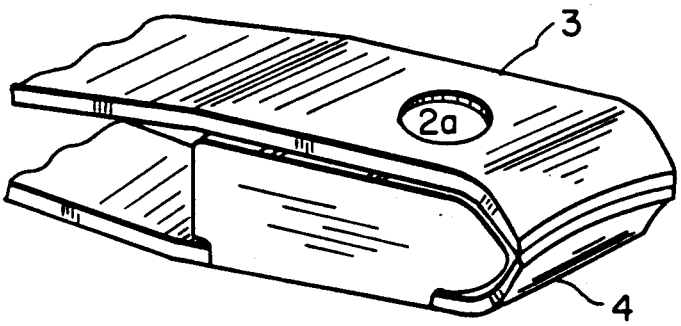

FIG. 6 shows the upper jaw over the lower jaw with its integral retaining box in the clipping mode.

Figure 7:
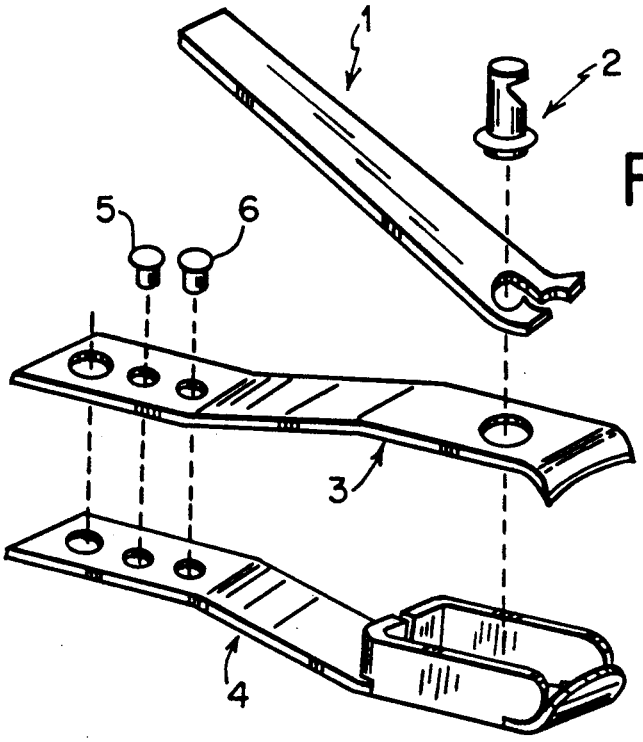

FIG. 7 shows an exploded view of the nail clippers with the clippings retaining box according to the new invention.

Figure 1:
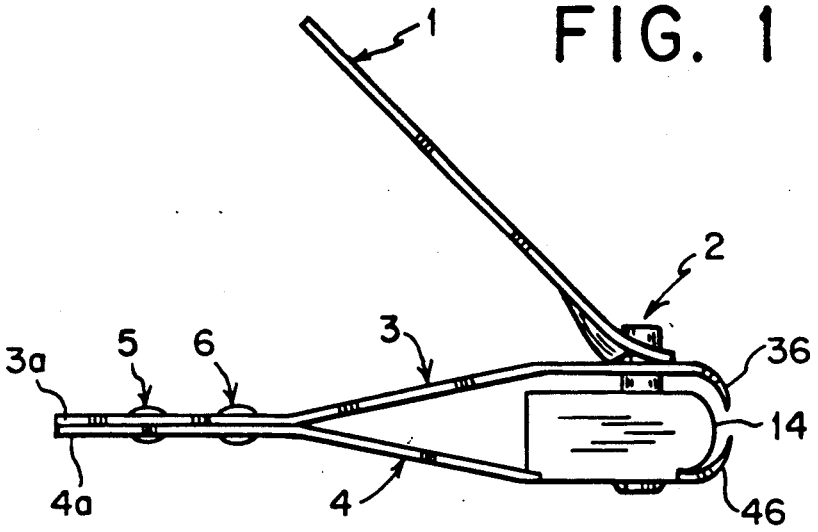
FIG. 1 is a side view of the nail clipper of this invention in its non-clipping mode. In this view, 1 refers to the actuating lever, 2 refers to the main rivet, 3 refers to the upper jaw, 4 depicts the lower jaw according to the new invention, and 5 and 6 refer to rivets permanently holding the jaws together.

Actuating lever 1, rivet 2, the upper jaw 3 of FIG. 1 may be similar to those used in commercially available nail clippers, as, for example, described in U.S. Pat. No. 2,477,782.

The lower jaw of FIG. 1 and FIG. 2 represents the new and original part of this invention. In the manufacture of this lower jaw the following steps may be taken:

1. Sheet metal of similar thickness to that of a commercially marketed nail clipper is cut, or blanked, as shown in FIG. 3.

2. The blanked sheet metal in FIG. 3 is then formed by composite bending into the shape shown in FIG. 4; dashed lines of FIG. 3 indicating the bend lines in producing the ultimate shape of the lower jaw.

Lever 1, jaws 3 and 4 of FIG. 1 may be of a metal alloy which lends itself to blanking, forming, required heat treatment, grinding, and plating. A low carbon steel in sheet form, for example, may be utilized with subsequent case hardening, grinding, and plating (chrome or other) operations. Other metals such as alloy steels, as well as other metal base alloys can be used for this purpose.

The nail clipper parts, jaws 3 and 4 of FIG. 1, may be permanently assembled by riveting as shown at locations 5 and 6 in FIG. 1; or by spotwelding prior to heat treatment and plating operations of assembly.

In the non-clipping mode the nail clipper presents a minimum clearance of 0.125" between the upper jaw and the lower jaw retainer box; in the clipping mode the maximum clearance should not exceed 0.030" between the upper jaw and the lower jaw retainer box.

The fingernail and toenail clipper comprises a longitudinal center-line 13. The re is also the upper jaw 3 having a first end 3*a* and a second end 3*b*, with there being a lower jaw 4 having a first end 4*a* and a second end 4*b*. Means 5 is for attaching the upper jaw at the first end to the lower jaw at the first end. There is a main rivet 2 for attaching the second end of the upper jaw a spaced distance above the second end of the lower jaw. A nail clipping retaining box 14 is positioned beneath the second end 3*b* of the upper jaw 3 and is integrally attached to and above the second end 4*b* of the lower jaw 4, without being attached to the upper jaw, so that the retaining box is between the upper and lower jaws. The retaining box 145 includes a first extension 8*a* laterally attached along one side 10*a* of the lower jaw second end 4*b*, with the first extension having a back end comprising a first foldable flap portion 12*a*. The retaining box also comprises a second extension 8*b* laterally attached along the other side 10*b* of the lower jaw second end, with the second extension having a back end comprising a second foldable flap portion 12*b* . Therefore, the retaining box 14 further has each of the first extension and the second extension folded along each's laterally attached side, so as to be perpendicular to the lower jaw, but parallel to the longitudinal centerline 13. Each extension has it respective back end foldable flap portion folded, so as to be simultaneously perpendicular to the lower jaw and perpendicular to the longitudinal center-line so as to complete the construction of the retaining box.

What is claimed is:

1. A fingernail and toenail clipper comprising:

a longitudinal center-line;

an upper jaw having a first end and a second end;

a lower jaw having a first end and a second end;

means for attaching said upper jaw at said first end to said lower jaw at said first end;

a main rivet for attaching said second end of said upper jaw a spaced distance above said second end of said lower jaw;

a nail clipping retaining box positioned beneath said second end of said upper jaw and integrally attached to and above said second end of said lower jaw, without being attached to the upper jaw, so that said retaining box is between said upper and lower jaws, said main rivet passing through said retaining box;

said retaining box comprising a first extension laterally attached along one side of the lower jaw second end, with said first extension having a back end comprising a first foldable flap portion, and a second extension laterally attached along the other side of the lower jaw second end, with said second extension having a back end comprising a second foldable flap portion; and whereby said retaining box further comprises having each of the first extension and the second extension folded along each's laterally attached side, so as to be perpendicular to the lower jaw, but parallel to the longitudinal center line, and each extension having its back end foldable flap portion folded so as to be simultaneously perpendicular to the lower jaw and perpendicular to the longitudinal center-line, so as to complete the construction of the retaining box.

2. The nail clipper according to claim 1, wherein the box of the lower jaw is so tailored that, in the nail clipping mode, the upper jaw covers the box of the lower jaw completely, preventing any nail clippings from flying out of the box.

3. The nail clipper according to claim 1, wherein the non-clipping mode, the nail clipper presents a minimum clearance between the upper jaw and the lower jaw retainer box.

4. The nail clipper according to claim 1, further comprising an actuating lever.

* * * * *